United States Patent [19]

Baker

[11] Patent Number: 4,827,102

[45] Date of Patent: May 2, 1989

[54] HEATING SYSTEM

[76] Inventor: Michael E. Baker, 8 Charles Plz., Suite 805, Baltimore, Md. 21201

[21] Appl. No.: 203,981

[22] Filed: Jun. 8, 1988

[51] Int. Cl.[4] ..... H05B 3/34

[52] U.S. Cl. ..... 219/211; 219/527; 219/529

[58] Field of Search ..... 219/211,527, 528, 529, 219/549

[56] References Cited

U.S. PATENT DOCUMENTS

| | | | |
|---|---|---|---|
| 2,287,915 | 6/1942 | Taylor | 219/211 |
| 2,329,766 | 9/1943 | Jacobsen | 219/527 |
| 2,458,119 | 1/1949 | Van Daam | 219/211 |
| 2,579,383 | 12/1951 | Goudsmit | 219/527 |
| 2,627,018 | 1/1953 | Duren | 219/527 |
| 3,407,818 | 10/1968 | Costanzo | 219/211 |
| 4,279,255 | 7/1981 | Hoffman | 219/211 |

*Primary Examiner*—Teresa J. Walberg

*Attorney, Agent, or Firm*—Morton J. Rosenberg

[57] ABSTRACT

A heating system (10) adapted to be worn by an individual (50) is provided. The heating system (10) includes at least one belt member (20) containing a heating strip (30) therein. Heating strip (30) is formed by a pair of heating elements (32) and (34) in substantially parallel relation throughout the length of belt member (20). Belt member (20) is maintained in substantially contiguous contact with a substantial longitudinal portion of the user's body (50) by a plurality of strap members (40), (42), (44), and (46). Strap members (40), (42), and (44) are provided with a Velcro hook and loop type fastening system having a latch element (92) and a hook element (94).

20 Claims, 3 Drawing Sheets

HEATING SYSTEM

BACKGROUND OF THE INVENTION

1. Field of the Invention

This invention directs itself to heating systems which are worn by an individual. In particular, this invention directs itself to an individual heating system for providing heat to a substantial portion of a longitudinal surface area of the individual's body. Still further, this invention directs itself to heating systems which include at least one continuous elongate flexible heating belt member positioned in substantially contiguous contact with the individual's body. More in particular, this invention pertains to heating systems which include a heating strip located within the elongate belt member having a pair of colinear heating elements. Further, this invention directs itself to heating systems which include a means for securing the belt member to the individual's body. Still further, this invention directs itself to heating systems which are adapted to receive power from portable self-contained sources, motor vehicle power systems, or engine powered generators.

2. Prior Art

Heating systems adapted to be worn are known in the art. The best prior art known to the applicant include U.S. Pat. Nos: 3,751,620; 3,419,702; 4,665,308; 2,692,326; 4,532,410; 3,778,590; 3,644,705; 4,570,635; 4,061,897; 4,404,460; 3,153,720; and 3,999,037.

Some prior art systems such as that shown in U.S. Pat. Nos. 3,751,620 and 4,665,308 are directed to electrically heated garments for warming an individual's body. The heating elements either incorporated into the inner lining of the garment, or inserted into pockets provided thereon provide heat to the body, but are cumbersome and cannot optionally be worn either above or below other clothing. These references are not directed to an individual heating system formed as a strip-like member which may be either sandwiched between the body and other garments or optionally placed on top of the user's apparel.

In other prior art systems, such as U.S. Pat. No. 2,692,326, there is provided an electrically heated shoe, and like other such systems commercially available, these type systems provide heat to only a small portion of the user's body. Such systems providing electrically heated gloves, socks, scarves or shoes are intended to only provide heat to the extremities and do not provide heat to a substantial longitudinal portion of the user's body, as provided by the instant invention.

SUMMARY OF THE INVENTION

A heating system adapted to be worn by an individual is provided. The heating system includes at least one continuous elongate flexible heating strip member positioned over a substantial portion of a longitudinal surface area of a person's body, and in substantially contiguous contact therewith. The heating system further includes a means for securing the heating strip member to the individual's body so as to provide a releasable coupling thereto. Also included in the heating system is a power source electrically coupled to the heating strip member to provide the necessary electric current required to generate the heat provided to the individual's body by this system.

DESCRIPTION OF THE PREFERRED EMBODIMENTS

Referring now to FIGS. 1–7, there is shown heating system 10 adapted to be worn by an individual so as to function as an electrically heated garment. As will be seen in following paragraphs, heating system 10 is specifically directed to the concept of providing thermal transport from an electrically powered heating element to a substantial portion of a longitudinal surface area of an individual's body 50. Heating system 10 is particularly well suited for use by sportsmen and workers who spend many hours outdoors during cold and inclement weather. Additionally, heating system 10 advantageously provides a very light and non-restraining electrically heated garment which provides warmth to a major portion of an individual's body 50, namely the torso and legs.

Figure 2:
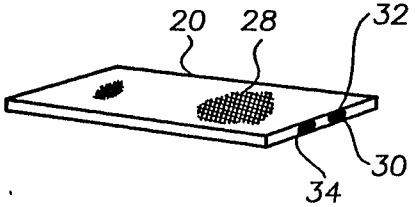
FIG. 2 is a perspective view of a portion of the heating strip for a preferred embodiment of the invention.
Figure 1:
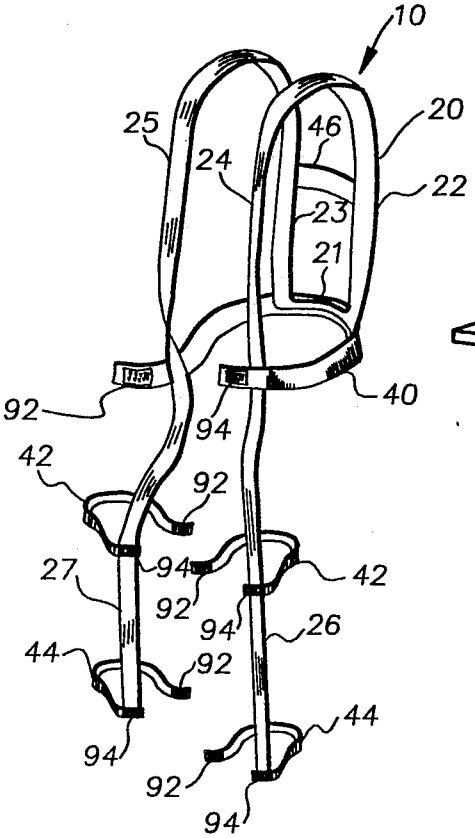
FIG. 1 is a perspective view of the heating system.

Heating system 10 is constructed from a belt member 20, shown in FIGS. 1 and 2, which is worn by an individual and positionally located about the body to be in substantially contiguous contact with a substantial portion of a longitudinal surface area of the individual's body 50. Located within belt member 20 is a heating strip 30, extending longitudinally therethrough. Belt member 20 forms a support structure, or housing for heating strip 30. Heating strip 30 includes a pair of heating elements 32 and 34 which are collocated throughout the length of belt member 20.

As shown in FIGS. 1–4, belt member 20 is fitted to the individual's body 50 such that a portion of the heat generated within belt member 20 by heating strip 30 will be transmitted to both the front and rear portions of the user's torso, as well as to each of the user's legs. Thus, a single electrically heated garment provides heat to the substantial central portion of an individual's body 50.

Belt member 20 is formed by a longitudinally extended strip of material 28, folded or otherwise formed into a housing for containing heating strip 30. Although not important to the inventive concept, material 28 may be a textile composition to provide a light and flexible housing for heating strip 30. Obviously, other material compositions could be used in place of textile material 28, such as plastics, woven or extruded, woven metal braids, or elastomeric compositions. The extended length of belt member 20 includes a pair of leg portions 26 and 27 respectively, a pair of front torso portions 24 and 25 respectively, and a pair of rear torso portions 22 and 23 respectively, and a crossover portion 21 located between rear torso portions 22 and 23.

Heating system 10 is conveniently provided with a means for securing belt member 20 to the user's body 50. A plurality of strap members 40, 42, 44, and 46 provide a convenient means for maintaining belt member 20 properly positioned on the user's body 50. Waist strap member 40 being coupled to a portion of strap member 20 located intermediate the torso portion 25 and leg portion 27, extends around the waist of the user 50 to rear torso portion 23, across the user's back to rear torso portion 22, and around the other side of the waist to a location intermediate front torso portion 24 and leg portion 26. Waist strap member 40 may be located relative to belt member 20 so as to overlay the crossover portion 21 of belt member 20, when it is desired to provide heat in the area of the small of the back, or alternatively, crossover portion 21 may extend in a loop below waist strap member 40 when it is desired to provide heat to the buttocks area.

To prevent either of the portions of belt member 20 consisting of portions 22 and 24, or portions 23 and 25 from slipping off the shoulders of the user, a rear torso strap member 46 may be provided, coupled between the rear torso portions 22 and 23 of belt member 20. To maintain the leg portions 26 and 27 of belt member 20 in substantially contiguous contact with the legs of the user, each leg portion is provided with an upper leg strap member 42 and a lower leg strap member 44.

Each of the strap members 40, 42, 44, and 46 include a means for fastening opposing ends of the strap members together to form a continuous loop around that portion of the user's body located adjacent the strap member. Although the type of fastening means is not important to the inventive concept, in one particular working embodiment, a Velcro hook and loop type attachment system has been successfully utilized having a latch portion 92 and a hook portion 94.

Figure 4:
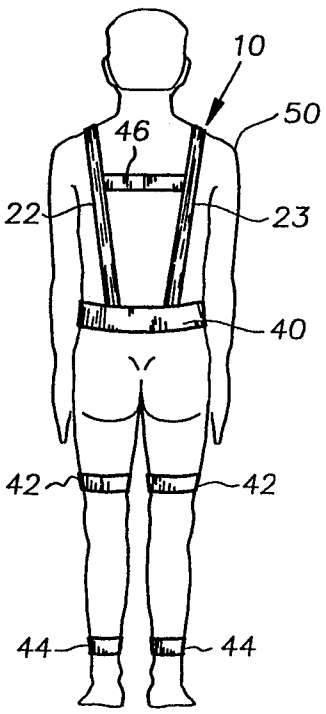
FIG 4 is a rear plan view of the invention worn by an individual.
Figure 3:
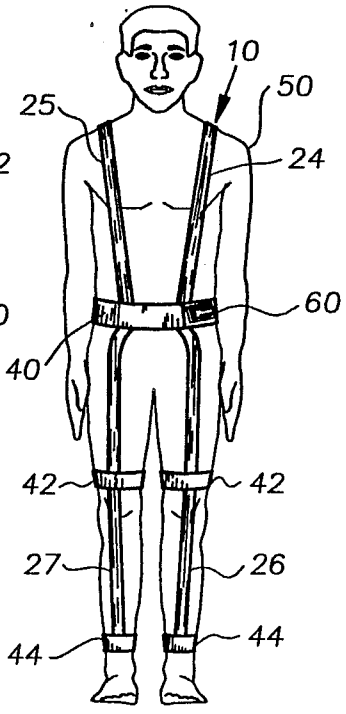
FIG. 3 is a front plan view of the invention worn by an individual.

Referring now to FIGS. 2 and 3, heating elements 32 and 34 are provided within belt member 20 to convert electrical energy to thermal energy. Therefore, a means must be provided to connect a power source to the heating strip 30. An electrical connector 60 located on waist strap member 40 serves this purpose. Electrical connector 60 provides the interconnection between a power source, to be described in following paragraphs, and the heating elements 32 and 34 of heating strip 30. The method of connecting electrical connector 60 to heating elements 32 and 34 is not important to the inventive concept, as there are many acceptable alternative methods which can be used. In one working embodiment, electrical connector 60 is coupled to heating elements 32 and 34 at a point substantially midway between the opposing ends of belt member 20, with each of heating elements 32 and 34 being serially coupled one to the other at both opposing ends of belt member 20. Thus, each half of heating strip 30 is connected in parallel relationship with the other half. For this purpose, commercially available heating strip having the designating part #18107, available from Northern Electric Co. of Hattiesburg, Miss., has been successfully used. Alternately, electrical connector 60 could be coupled to heating elements 32 and 34 at one end of belt member 20, with heating elements 32 and 34 being serially coupled to one other at the opposing end.

Belt member 20 may be alternately formed from a pair of members arranged to be laterally displaced each from the other on the user's body 50, being configured similar to that shown in FIG. 1, with the elimination of crossover portion 21 of belt member 20. Likewise, it would be obvious to add additional belt members 20 for providing heat to additional areas of the body. Such additional members could be provided to extend down the arms of the user, down the backs of legs, or over the head.

Figure 5:
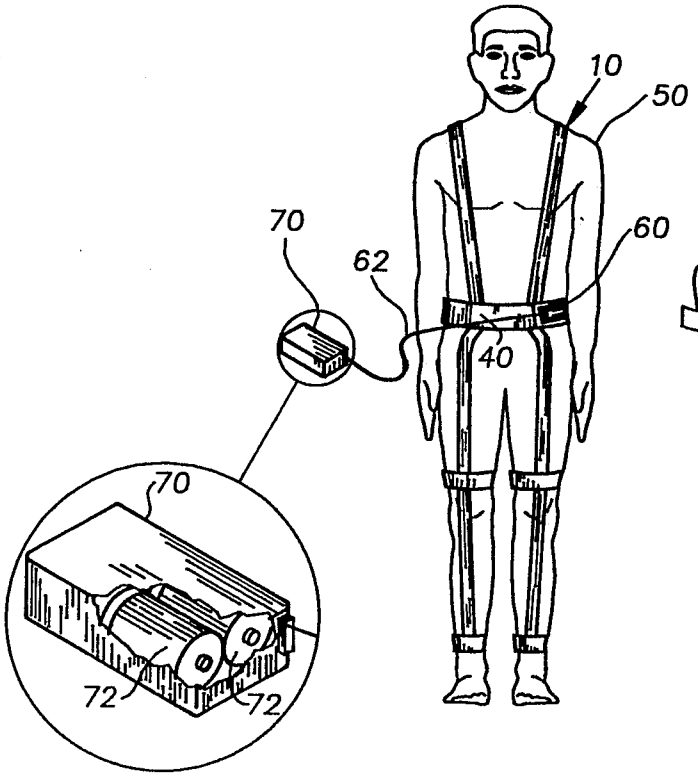
FIG. 5 is a plan view of a preferred embodiment and portable power source.

Heating system 10 may be worn on top of, or beneath other clothing as desired by the user 50. Electrical connector 60 may be connected to a portable power supply 70 which may be conveniently located and mechanically coupled to waist strap member 40 or any other garment of the user's apparel. Portable power supply 70, as shown in FIG. 5, is electrically coupled to electrical connector 60 of heating system 10 by connecting power cable 62. As shown, portable power supply 70 may contain a plurality of individual battery cells 72 connected so as to provide the proper voltage and current necessary for proper operation of heating system 10. Battery cells 72 may be any of a variety of battery cells, such as alkaline dry cells, rechargeable nickel cadmium cells, or sealed lead-acid storage batteries.

Figure 6:
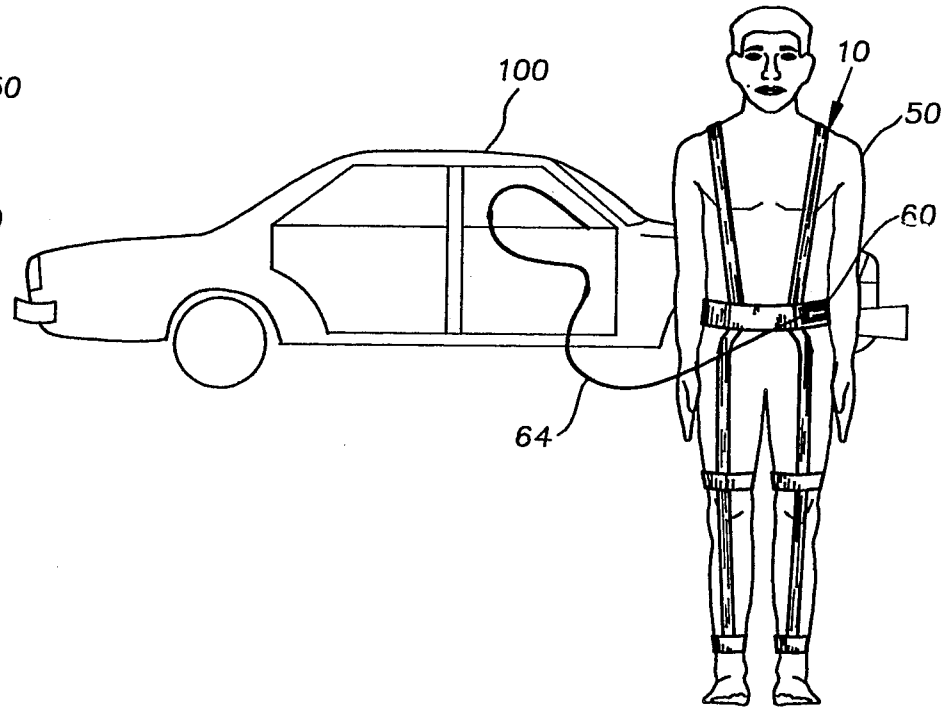
FIG. 6 is a plan view of the invention shown coupled to an automotive power source; and, FIG. 7 is a plan view of a plurality of systems according to the inventive concept shown coupled to a single power source.

Alternately, heating system 10, shown in FIG. 6, may be provided with an adapter power cable for use with the cigar lighter socket (not shown) of a motor vehicle 100. Thus, adapter power cable 64 is provided with the appropriate plug type connector, as is well known in the art, for connection to the automotive cigar lighter socket at its distal end and the appropriate connection for interface with electrical connector 60 at its proximal end. Obviously, adapter power cable 64 is of great benefit to those forced to make repairs to a motor vehicle, such as changing a tire, during cold or inclement weather, the power system of motor vehicle 100 providing power to heating system 10 for possibly an extended length of time, having a greater energy capacity than provided by power supply 70.

Figure 7:
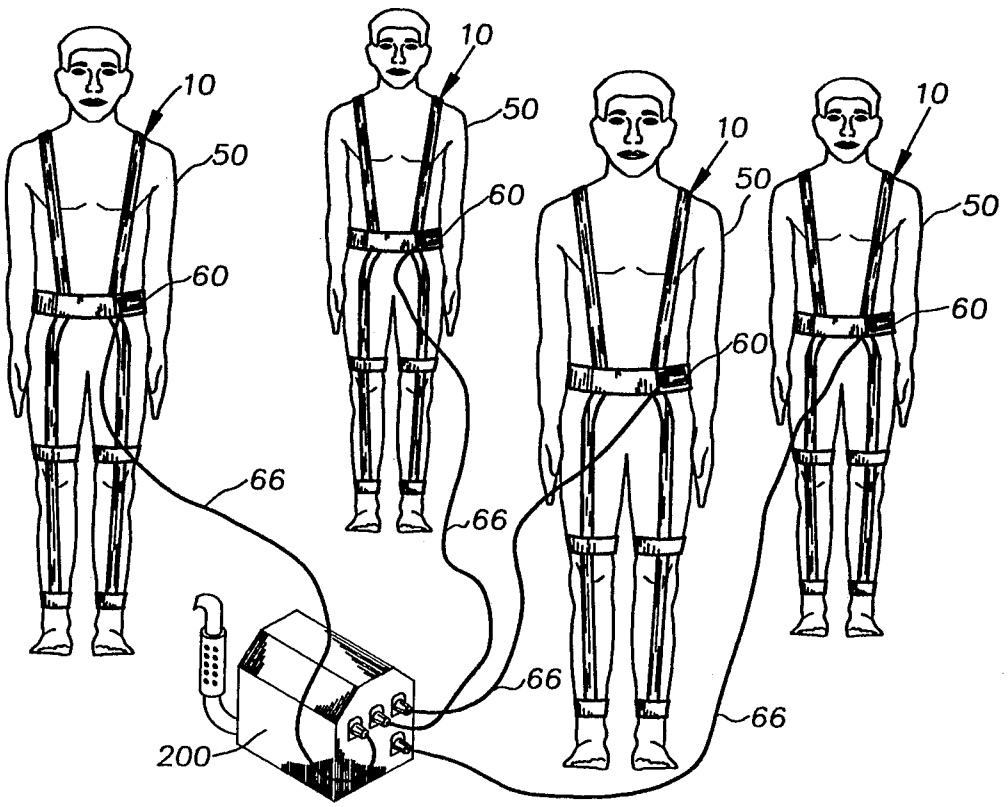

Referring now to FIG. 7, there is shown a plurality of individuals 50, each having their own individual heating system 10 coupled to a common power source 200. Each of heating systems 10 are coupled to electrical generator 200 by a connecting power cable 66. Electrical generator 200, driven by a petrochemically fueled engine, is adapted to provide a plurality of output terminals for connection to multiple individual heating systems 10. The power source arrangement shown in FIG. 7 is particularly advantageous to work crews whose function must be carried out regardless of weather conditions. Each of the work crew members 50, being located in relative close proximity to one another, can be conveniently provided with electrical energy, from a common source, for powering their own personal heating system 10.

As has been previously described, heating system 10, shown in FIGS. 1–4, includes at least one belt member 20 having a heating strip 30 contained therein. Belt member 20 partially encompasses both the front and rear portions of the user's torso, as well as having portions 26 and 27 partially encompassing a portion of each leg of the user. Thus, a large longitudinal portion of the user's body is provided with heat distributed by belt member 20. Electrical energy is coupled to heating system 10 through an electrical connector 60 which provides the connection between the energy source and the individual heating elements 32 and 34 of heating strip 30.

The combination of belt member 20 and heating strip 30 contained therein, provides a lightweight and flexible electrically heated garment for use beneath or on top of other clothing. Heating system 10 advantageously provides a single garment which provides heat to a substantial portion of the user's body 50, providing heat to both the torso and legs. It is further contemplated that additional belt members 20 can be added to heating system 10 to provide further distribution of heat to the user's arms, buttocks, rear portions of the legs, and the head.

Belt member 20 of heating system 10 is maintained in position on the user's body 50 by a plurality of strap members 40, 42, 44, and 46 Waist strap member 40, in addition to providing means for securing belt member 20 in position on the user's body 50, provides support for the electrical connector 60. Rear torso strap member 46 maintains the spatial relationship between rear torso portions 22 and 23 of belt member 20, for preventing portions of belt member 20 from slipping from the shoulders of the user's body 50. Upper leg strap members 42 and lower leg strap members 44 are provided to maintain leg portions 26 and 27 of belt member 20 positionally located and in substantially contiguous contact with portions of the respective legs of the user.

As shown in FIGS. 5–7, heating system 10 may be powered from a wide range of power sources. A completely independent and ambulatory system is provided by power source 70 coupled to electrical connector 60 of heating system 10 by a connecting cable 62. Power source 70 contains a plurality of individual battery cells 72, which may be replaceable or rechargeable, at the option of the user. Heating system 10 is further provided with an adapter power cable 64 for connecting heating system 10 to an automotive cigar lighter socket, provided within motor vehicle 100. Alternatively, an engine generator system 200 can be provided to power a plurality of heating systems 10 through multiple power connecting cables 66, each cable 66 connecting an individual heating system 10 to the power generator 200.

Although this invention has been described in connection with specific forms and embodiments thereof, it will be appreciated that various modifications other than those discussed above may be resorted to, without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A heating system adapted to be worn by an individual, comprising:

a. heating means for providing thermal energy to at least a portion of a person's body, said heating means including at least one continuous elongate flexible heating strip member within an elongate belt member positionally located in substantially contiguous contact with said body over a substantial portion of a longitudinal surface area of said body extending from one end juxtaposed a torso portion of said body to an opposing end juxtaposed a leg portion of said body;

b. securement means coupled to said heating means for releasably coupling said heating means to said body; and, c. power source means coupled to said heating means for providing an electrical current to generate said thermal energy provided to said body.

2. The heating system as recited in claim 1 wherein said heating means includes a pair of heating elements located within said belt member.

3. The heating system as recited in claim 2 wherein said heating means further includes connector means for electrically coupling said power source means to said heating element member.

4. The heating system as recited in claim 1 wherein said heating means includes a pair of said heating strip members within elongate belt members laterally displaced each from the other on said body.

5. The heating system as recited in claim 4 wherein said pair of heating strip members together are in substantially contiguous contact with both a front and rear portion of a torso and both legs of said individual.

6. The heating system as recited in claim 1 wherein said power source means includes a portable battery pack carried by an individual.

7. The heating system as recited in claim 1 wherein said power source means includes adapter means for coupling said heating strip member to an automobile cigar lighter socket.

8. The heating system as recited in claim 1 wherein said power source means includes electrical generator means coupled to said heating means for providing said electrical current, said electrical generator means being adapted to power a plurality of said heating systems.

9. The heating system as recited in claim 1 wherein said securement means includes (1) a plurality of strap members each having a pair of opposing ends; each of said strap members being fixedly coupled to said belt members, and (2) a means for releasably coupling each of said strap member opposing ends on the another.

10. The heating system as recited in claim 9 wherein said means for releasably coupling each of said strap member opposing ends includes a hook and loop type attachment system.

11. The heating system as recited in claim 1 wherein said belt member is formed from a textile material composition.

12. An electrically heated garment for, warming a substantial portion of an individual's body, comprising:

a. a belt member encompassing both a front and rear portion of a torso of an individual, said belt member having a pair of opposing ends where each of said ends further encompasses a portion of an opposing leg of said individual;

b. heating means for converting electrical energy to thermal energy enclosed within said belt member;

c. power source means coupled to said heating means for providing said electrical energy; and, d. securement means coupled to said belt member for releasably coupling said belt member to said individual.

13. The electrically heated garment as recited in claim 12 wherein said heating means includes a pair of heating elements members in substantially parallel relation within said belt member.

14. The electrically heated garment as recited in claim 13 wherein said heating means further includes connector means for electrically coupling said power source means to said pair of said heating elements.

15. The electrically heated garment as recited in claim 12 wherein said power source means includes a portable battery pack carried by said individual.

16. The electrically heated garment as recited in claim 12 wherein said power source means includes adapter means for coupling said heating means to an automobile cigar lighter socket.

17. The electrically heated garment as recited in claim 12 wherein said power source means includes electrical generator means coupled to said heating means for providing said electrical energy; said electrical generator means being adapted to power a plurality of said electrically heated garments.

18. The electrically heated garment as recited in claim 12 wherein said securement means includes (1) a plurality of strap members having a pair of opposing free ends; each of said plurality of strap members being fixedly coupled to said belt member, and (2) a means for releasably coupling each of said strap member opposing free ends one to the other.

19. The electrically heated garment as recited in claim 18 wherein said means for releasably coupling each of said strap member opposing ends includes a hook and loop type attachment system.

20. The electrically heated garment as recited in claim 12 wherein said belt member is formed from a textile material composition.

* * * * *